United States Patent [19]

Montanez

[11] Patent Number: 4,910,651

[45] Date of Patent: Mar. 20, 1990

[54] HIGH WATTAGE INSULATED CEILING LIGHTING FIXTURE

[75] Inventor: Jesse J. Montanez, Monterey Park, Calif.

[73] Assignee: Thomas Industries Inc., Los Angeles, Calif.

[21] Appl. No.: 235,169

[22] Filed: Aug. 23, 1988

[51] Int. Cl.[4] ..... F21S 1/06

[52] U.S. Cl. ..... 362/148; 362/365; 362/418

[58] Field of Search ..... 362/147, 364, 365, 418, 362/430, 148

[56] References Cited

U.S. PATENT DOCUMENTS

| | | | |
|---|---|---|---|
| 2,297,124 | 9/1942 | Anderson et al. | 362/147 |
| 2,465,248 | 3/1949 | McCandless | 362/147 |
| 2,556,690 | 6/1951 | Guth | 362/364 |
| 2,716,185 | 8/1955 | Burliuk et al. | 362/364 |
| 2,741,695 | 4/1956 | Schockett | 362/147 |
| 2,802,933 | 8/1957 | Broadwin | 362/364 X |
| 2,859,333 | 11/1958 | Burliuk et al. | 362/147 |
| 2,899,542 | 8/1959 | De Mauro | 362/364 |
| 2,922,030 | 1/1960 | Bobrick | 362/147 |
| 3,040,172 | 6/1962 | Chan | 362/147 |
| 3,104,833 | 9/1963 | Stuart et al. | 362/147 |
| 3,130,949 | 4/1964 | Erhardt et al. | 362/147 |
| 3,158,329 | 11/1964 | Wince | 362/364 |
| 3,268,721 | 8/1966 | Dworkin et al. | 362/364 |
| 3,286,090 | 11/1966 | Prown | 362/147 |
| 3,291,979 | 12/1966 | Logan | 362/147 |
| 3,300,634 | 1/1967 | Liberman | 362/147 |
| 3,310,672 | 3/1967 | Bursell | 362/147 |
| 3,313,931 | 4/1967 | Klugman | 362/364 |
| 3,316,399 | 4/1967 | Totten | 362/147 |
| 3,370,165 | 2/1968 | Chan | 362/147 |
| 3,375,368 | 3/1968 | Dorsky | 362/364 |
| 3,518,420 | 6/1970 | Kripp | 362/364 |
| 3,609,346 | 9/1971 | Lund et al. | 362/364 |
| 3,660,651 | 5/1972 | Miles, Jr. | 362/147 |
| 3,683,173 | 8/1972 | Guth, Jr. et al. | 362/147 |
| 3,697,742 | 10/1972 | Bobrick | 362/364 |
| 3,721,817 | 3/1973 | Contratto | 362/147 |
| 3,778,609 | 12/1973 | Liberman | 362/147 |
| 3,801,815 | 4/1974 | Docimo | 362/364 |
| 3,852,583 | 12/1974 | Puyplat | 362/366 |
| 3,878,505 | 4/1975 | Seibert | 362/282 |
| 3,895,227 | 7/1975 | Murray et al. | 362/147 |
| 4,039,822 | 8/1977 | Chan et al. | 362/364 |
| 4,048,491 | 9/1977 | Wessman | 362/364 |
| 4,054,790 | 10/1977 | Slaughter | 362/264 |
| 4,081,667 | 3/1978 | Lewin et al. | 362/296 |
| 4,163,276 | 7/1979 | Tabatchnik-Michaell | 362/255 |
| 4,173,037 | 10/1979 | Henderson, Jr. et al. | 362/418 X |
| 4,181,930 | 1/1980 | Mewissen et al. | 362/296 |
| 4,186,433 | 1/1980 | Baldwin | 362/263 |
| 4,197,574 | 4/1980 | Weiss | 362/294 |
| 4,232,361 | 11/1980 | Kelsall | 362/364 |
| 4,238,815 | 12/1980 | Price | 362/218 |
| 4,254,455 | 3/1981 | Neal, Jr. | 362/296 |
| 4,274,615 | 6/1981 | Chan et al. | 248/343 |
| 4,293,895 | 10/1981 | Kristofek | 362/147 |
| 4,302,798 | 11/1981 | Hoffman | 362/147 |
| 4,302,801 | 11/1981 | Duddy | 362/345 |
| 4,306,279 | 12/1981 | Cohen | 362/365 |
| 4,313,154 | 1/1982 | Capostagno et al. | 362/365 |

(List continued on next page.)

FOREIGN PATENT DOCUMENTS

| | | | |
|---|---|---|---|
| 230619 | 7/1958 | Australia | 362/364 |
| 595142 | 3/1960 | Canada | 362/365 |
| 1176345 | 4/1959 | France | 362/365 |

*Primary Examiner*—Ira S. Lazarus
*Assistant Examiner*—Richard R. Cole
*Attorney, Agent, or Firm*—Hill, Van Santen, Steadman & Simpson

[57] ABSTRACT

An adjustable socket plate member for a recessed ceiling lighting fixture, includes a plate member adapted to receive a lamp socket and a leg member which an elongated slot and a circular aperture which receive a securing member associated with a lamp housing for selective positioning of the plate member within the lamp housing. Furthermore, a rectangular box shaped enclosure is provided for the recessed ceiling lighting fixture to prevent overheating of the fixture by creating an air space between the fixture and any insulation surrounding the fixture.

8 Claims, No Drawings

U.S. PATENT DOCUMENTS

| | | | |
|---|---|---|---|
| 4,321,659 | 3/1982 | Wheeler | 362/293 |
| 4,327,403 | 4/1982 | Capostagno et al. | 362/276 |
| 4,336,575 | 6/1982 | Gilman | 362/147 |
| 4,358,635 | 11/1982 | Druffel | 174/101 |
| 4,368,506 | 1/1983 | Rapp | 362/147 |
| 4,388,677 | 6/1983 | Druffel | 362/306 |
| 4,399,497 | 8/1983 | Druffel | 362/362 |
| 4,400,766 | 8/1983 | Munson | 362/376 |
| 4,403,277 | 9/1983 | Eargle, Jr. | 362/263 |
| 4,420,802 | 12/1983 | Smester et al. | 362/364 |
| 4,423,471 | 12/1983 | Gordin et al. | 362/96 |
| 4,453,203 | 6/1984 | Pate | 362/345 |
| 4,459,648 | 7/1984 | Ullman | 362/147 |
| 4,754,377 | 6/1988 | Wenman | 362/148 |

HIGH WATTAGE INSULATED CEILING LIGHTING FIXTURE

BACKGROUND OF THE INVENTION

1. Field of the Invention

The present invention relates generally to electrical fixtures and, in particular, to a high wattage recessed ceiling lighting fixture.

2. Discussion of the Related Art

A recessed ceiling lighting fixture is a common type of lighting fixture. In this type of fixture, a housing is located recessed within a ceiling. A lightbulb or lamp located within the housing is positioned so that the lowermost point is above, flush with, or extending only slightly below the ceiling. The fixture housing is designed to accommodate a lamp up to a certain rated wattage, the rated wattage depending upon the housing design and the location of the fixture.

Lighting fixtures of this type commonly encounter the problem of excessive heat buildup. While such light fixtures typically include a reflector for directing the majority of the infrared and visible light rays downwardly into the room, nevertheless a considerable amount of heat is transferred upwardly into the recess in which the fixture is mounted. This can subject the wiring of the light fixture to overheating, possibly causing failure of the wiring insulation and resulting in a risk of short circuits and fire. Furthermore, the space above a room ceiling is often filled with thermal insulation to prevent heat loss from the room through the ceiling. Such insulation is frequently formed of flammable material and, therefore, must be kept well away from the recessed lighting fixture to avoid any chance of fire. This clearance space impairs the effectiveness of the insulation.

To avoid the danger of overheating, it has been necessary in many applications that recessed lighting fixture arrangements be limited to use with incandescent lamps of no greater than a predetermined maximum wattage, such as 40 watts output so as to minimize the generated heat to an amount insufficient to produce excessive heat buildup. This, of course, also limits the light output.

SUMMARY OF THE INVENTION

The present invention provides an enclosure for a recessed ceiling lighting fixture that ensures a sufficient air space between the housing and the insulation to prevent excessive heat buildup and that prevents insulation from falling through the plaster frame opening in the ceiling. To this end, a rectangular box-shaped enclosure is provided that is operatively attached to and completely surrounds a recessed ceiling lighting fixture. The enclosure creates an air space between itself and a lamp housing of the lighting fixture and serves in radiating the heat from the lighting fixture and in lowering the operating temperature of the fixture.

The enclosure is easily attached to a recessed lighting fixture. Two tabs of the enclosure are inserted through two slots in the plaster frame of the fixture. Once in place, the tabs are bent over to lock the enclosure in place. With the enclosure installed, the operating temperature at the outside of the fixture is lowered. Due to the lowering operating temperature in the fixture, higher wattage lamps can be used therein, thereby increasing the light output of the fixture.

The enclosure extends to the junction box of the fixture. This allows for access to the junction box from below the ceiling through the plaster frame opening.

The present invention also provides an adjustable socket plate that is selectively positionable in height within the lamp housing of the recessed ceiling lighting fixture. Such selective positioning allows lower wattage lamps to be positioned higher within the lamp housing while higher wattage lamps are positioned lower within the lamp housing.

To this end, there is provided a socket plate adapted to be received horizontally within the lamp housing and to accept a lamp socket therein. The socket plate includes a downwardly depending leg for securing the socket plate to the interior wall of the housing. The tab includes a vertical slot and a separate circular aperture in line with the slot through which is selectively received a bolt operatively attached to the housing. The bolt can be received in the aperture of the slot depending upon the wattage of the lamp to be used.

An object of the invention is to provide an improved recessed ceiling lighting fixture.

Another object of the invention is to provide a lamp socket plate for a recessed ceiling lighting fixture that is adjustable in position within a lamp housing.

A further object of the invention is to provide a recessed ceiling lighting fixture capable of having a reduced operating temperature.

Yet a further object of the invention is to provide an enclosure for a recessed ceiling lighting fixture that reduces the operating temperature of the fixture.

Yet another object of the invention is to provide a recessed ceiling lighting fixture that can accommodate higher wattage lamps due to its capability of operating at a lower temperature.

DETAILED DESCRIPTION OF THE PREFERRED EMBODIMENT

The present invention provides an enclosure for a recessed ceiling lighting fixture that lowers the operating temperature thereof by creating an air space between insulation surrounding the fixture and the fixture. Additionally, the invention provides a fixture that accommodates lamps of various wattages by including a lamp socket plate that can be positioned in any of a variety of positions.

Figure 1:
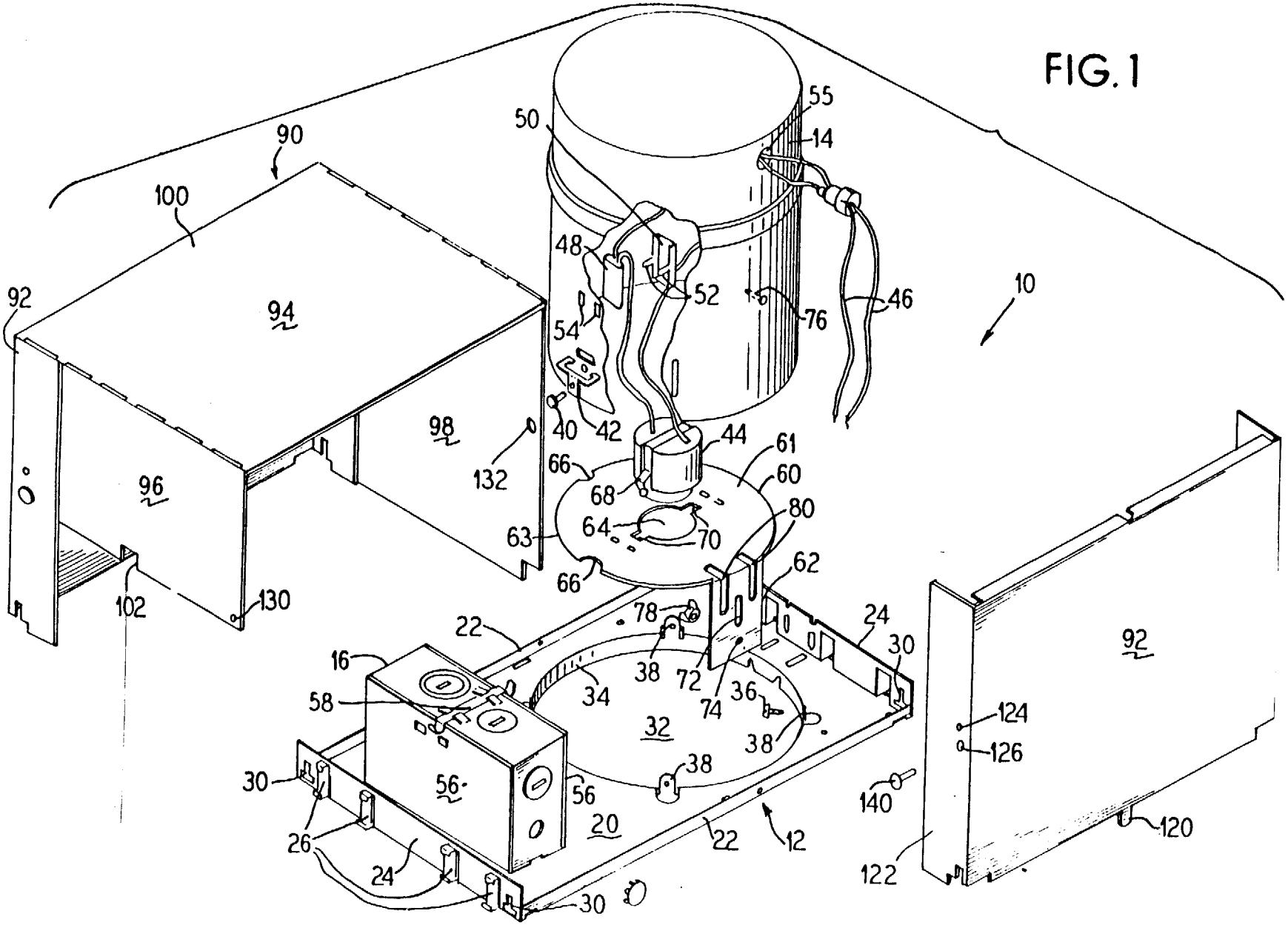
FIG. 1 is an exploded perspective view of a recessed ceiling lighting fixture including an enclosure and socket plate embodying principles of the invention.

A recessed ceiling lighting fixture 10 is illustrated in FIG. 1 in an exploded view to enable a better appreciation of the configuration thereof. As illustrated, the fixture 10 includes, as basic components thereof, a plaster frame subassembly or frame member 12, a cylindrical lamp housing 14 and a junction box 16.

The frame member 12 is rectangular in shape and includes a planar floor portion 20. Positioned on opposite sides of the frame floor 20 are two frame sides 22, which sides are relatively short in height. On the other opposite sides of the floor portion 20 are located two other frame sides 24, which are relatively higher in height. Formed in the frame sides 24 are hanger bar brackets 26 which have legs 28 that are bent outward from the sides 24. The hanger bar brackets 26 are used to support the frame member 12, and therefore the fixture 10, on certain suspension ceilings as is well-known in the art. Furthermore, frame sides 24 include T-shaped apertures 30 through which other support rods, not shown, are inserted for supporting the frame member 12, as is well-known in the art.

The planar floor portion 20 further includes a circular aperture 32 which is placed in registry with an aperture in the ceiling, not shown. To secure the aperture 32 about the aperture in the ceiling, the aperture 32 includes a downwardly depending rim 34 which engages the sides of the aperture in the ceiling.

Upstanding lugs 38 located alongside the aperture 32 serve to secure the lamp housing 14 to the frame member 12. A bolt or rivet 36 extends through the lamp housing 14 and into each upstanding lug 38.

A torsion spring bracket 42 is attached to the inside of lamp housing 14 by means of a rivet 40.

Located within the lamp housing 14 is a lamp socket assembly 44 to which are attached electrical wires 46. One of the wires 46 includes a thermal protection device 48 which is enclosed within a thermal enclosure 50 and affixed to the side of the lamp housing 14. The thermal enclosure 50 includes two leg portions 52 that are extended through slots 54 of the lamp housing 14 and then bent over to secure the thermal enclosure 50 to the lamp housing 14.

The wires 46 carry electrical power to the socket assembly 44 and are run through an opening 55 of the lamp housing 14 to the junction box 16. The wires 46 are inserted through an opening, not shown, in one of the covers 56 of the junction box 16. Access to the inside of the junction box 16 is had by lifting one of the legs of the riveted spring 58, the legs serving to secure each of the junction box covers 56.

As further illustrated in FIG. 1, the fixture 10 includes a socket plate 60 embodying principles of the invention. As can be seen, the socket plate 60 has a planar plate member 61 that is circular in shape and is adapted to fit within the fixture housing 14 in a horizontal position. Furthermore, the socket plate 60 includes an attaching and adjusting leg or leg member 62 depending and extending downwardly from the plate member 61. As illustrated, the attaching and adjusting leg 62 is formed at a right angle to the plate member 61 and is attached at an edge or rim 63 thereof.

The plate member 61 includes two notches 66 positioned at 90° relative to each other in the edge or rim 63. The notches 66 cooperate with ridges, not shown, within the fixture housing 14 and serve to ensure proper alignment of the socket plate within the fixture housing 14.

Centrally formed on the socket plate 60 is a socket aperture 64 including two notches 70 formed on an edge thereof. The socket aperture 64 is adapted to receive the lamp socket 44 located within the fixture housing 14. The notches 70 are adapted to receive resilient prongs 68 located on opposite sides of the lamp socket 44.

The attaching and adjusting leg 62 includes an elongated slot 72 positioned along an axis that is oriented perpendicularly to the plane of the socket plate member 61. The leg 62 also includes an aperture 74 located along the axis of the slot but positioned in spaced relation, just beyond the end of the slot furthest away from the plane of the socket plate member 61.

The slot 72 and aperture 74 cooperate with a bolt 76 that is operatively attached to and extends from an inside wall of the fixture housing 14. In one position, with the bolt 76 extending through the slot 72, the socket plate 60 is adjustable in height within a limited range within the fixture housing 14. In another position, with the bolt 76 extending through the aperture 74, the socket plate 60 is attached within the housing 14 in a single, fixed elevated position. A wing nut 78 serves to secure the leg 62 and, therefore, the socket plate 60 onto the bolt 76.

Lamps that operate a higher temperature should be installed at the lower position when the socket plate 60 is attached to the housing 14 by means of the bolt 76 extending through the slot 72, in order to keep the recessed ceiling lighting fixture 10 at an allowable temperature. Lamps that operate at lower temperatures can be installed at the upper positions when the socket plate 60 is attached to the lamp housing 14 by means of the bolt 76 extending through the slot 72 or the aperture 74.

The socket plate 60, just described, eliminates the need to stock two or more separate socket plates, each being attachable to the lamp housing 14 in only one position. Furthermore, by having a separate slot 72 and aperture 74, an installer of the recessed ceiling lighting fixture 10 is prevented from simply sliding the socket plate 60 to any desired position, high or low. Additionally, a label, not shown, indicating the socket plate 60 positions, lamp types and trim combinations can be affixed to the inside of the recessed ceiling lighting fixture to further ensure proper placement of the socket plate 60 and the use of only certain types of lamps and trim combinations in order to assure that high temperature lamps will be used only when the socket plate is placed in a low position.

A pair of reinforcing ribs 80 serve to provide rigidity to the attaching and adjusting leg 62. The ribs 80 also serve to ensure that a right angle is maintained between the attaching and adjusting leg 62 and the plate member 61.

Figure 2:
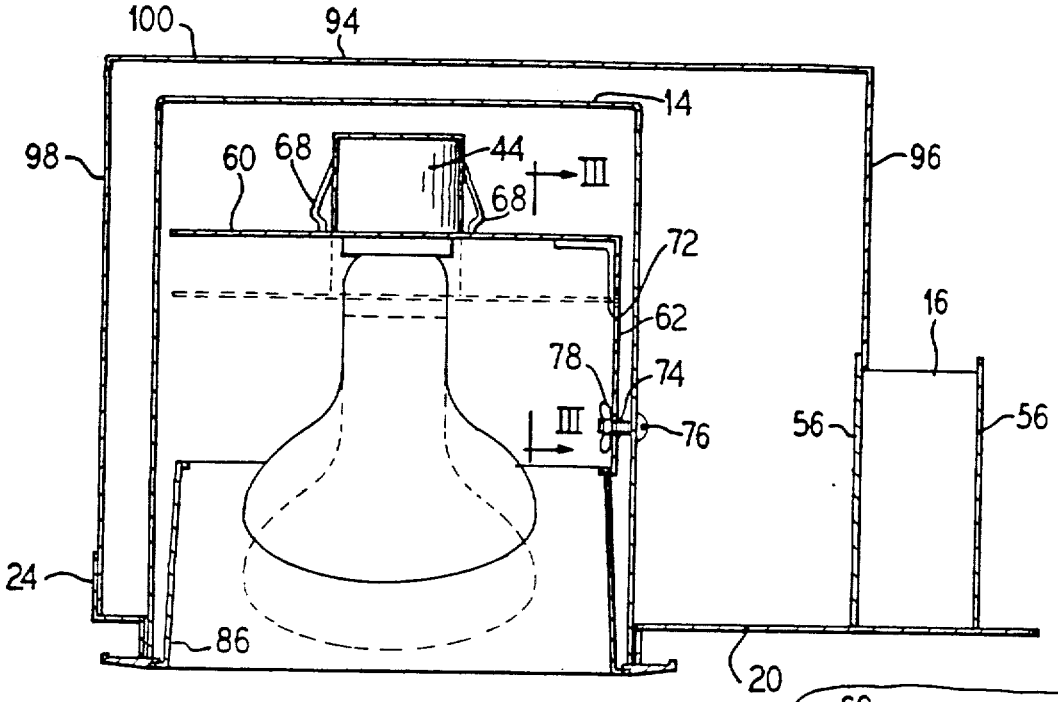
FIG. 2 is a side cross-sectional view illustrating multiple positioning of the socket plate of FIG. 1 and enclosure of the fixture by the enclosure of FIG. 1.
Figure 3:
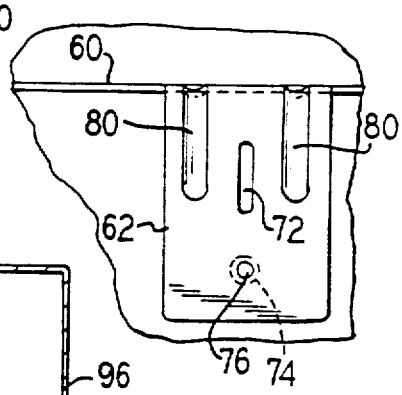
FIG. 3 is a fragmentary view of the socket plate of FIG. 1.
Figure 4:
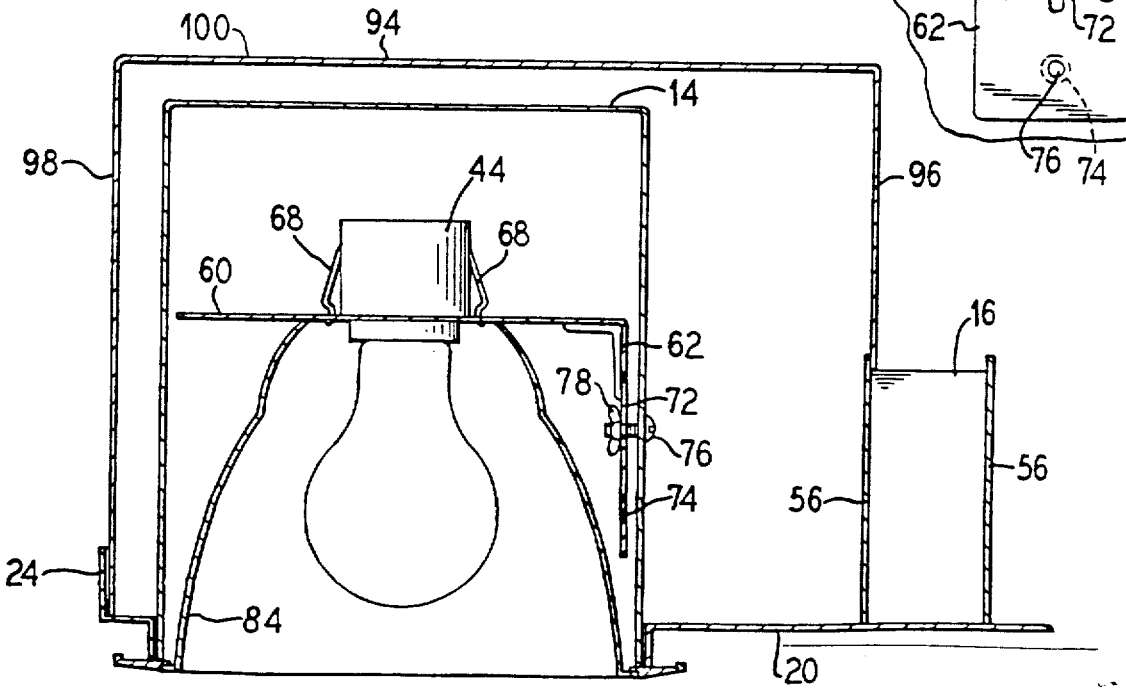
FIG. 4 is a side sectional view of another fixture including the plate and enclosure of FIG. 1, but including an alternative lamp reflector.

Illustrated in FIGS. 2 and 4 are the various adjustments that can be made utilizing the socket plate 60 within the lamp housing 14. It can be appreciated that the positioning of the socket plate 60 is dependent not only on the wattage of the lamp inserted into the socket 44 but also on the trim located on the underside of the ceiling and any reflector located with the lamp housing 14.

In FIG. 2, the socket plate 60 is illustrated as being positioned in the uppermost location within the lamp housing 14. In this position, the socket plate 60 is attached to the lamp housing 14 by means of the bolt 76, extending through the aperture 74. As discussed previously, this position is utilized for low wattage lamps as the recessed ceiling lighting fixture 10 will operate at a lower temperature with low wattage lamps and thus, a higher positioning of the lamp will not cause overheating of the fixture 10.

An alternative position for the socket plate 60 is also illustrated in FIG. 2 by means of dashed lines. The socket plate 60 is shown located in the lowermost position attainable when the socket plate 60 is attached to the lamp housing 14 by means of the bolt 76 extending through the slot 72. The slot 72, of course, allows the socket plate 60 to be positioned lower within the lamp housing 14 by loosening of the wing nut 78 and sliding of the leg 62 to another position along the bolt 76.

In FIG. 4, the socket plate 60 is again illustrated as being in the uppermost position attainable when the socket plate 60 is attached to the lamp housing 14 by means of the bolt 76 extending through the slot 72. However, in FIG. 4, there is illustrated a reflector 84 which is different than the reflector 86 illustrated in FIG. 2. Additionally, there is illustrated a different type of lamp. As discussed previously, the position of the socket plate 60 is, in part, determined by the reflector utilized. Thus, a tall reflector will cause higher positioning of the socket plate 60 while a shorter reflector will permit lower positioning of the socket plate 60.

With reference again to FIG. 1, an enclosure 90, embodying principles of the invention, is illustrated therein. The enclosure 90 is of a rectangular box shape having five sides or faces formed with panels and a sixth open side or face. The five paneled sides are designated accordingly: side covers 92; top panel 94; front panel 96; and back panel 98.

As illustrated, in the preferred embodiment, the front panel 94, the top panel 96, and the back panel 98 are integrally formed from a single sheet, top wrap 100, that is bent along parallel lines, the end portions forming the front panel 94 and the back panel 98 and the middle portion forming the top panel 96. Of course, the top wrap 100 may also be formed of separate panels that are welded or otherwise attached together along the edges thereof.

The front panel 94 is shorter than the back panel 98 as it rests on top of the junction box 16, as illustrated in FIGS. 2 and 4. By placing the front panel in this position, access is still provided to the junction box from outside the enclosure 90. Furthermore, access is provided from within the enclosure through the aperture 32 in the plastic frame member 12.

A notch 102 is operatively associated with the junction box cover spring 58 to allow raising of one leg of the spring 58 and therefore, to allow removal of the junction box cover 56 in the interior of the enclosure 90. The back panel 98 extends to the planar floor portion 20 of the frame member 12 and includes cutout corners at the bottom corners thereof. The cutout corners permit passage of rods through the T-shaped apertures 30 in the frame member 12.

Neither the front panel 96 nor the back panel 98 are directly attached to the frame member 12. Instead, the front and back panels 96 and 98 are attached to the side covers 92 that are, in turn, attached to the frame member 12.

The side covers 92, as illustrated in FIG. 1, are identical in configuration and therefore are interchangeable. Each side cover 92 includes a downwardly extending tab 120 that is accepted within a cooperating slot in the planar floor portion 20 of the frame member 12. Once the side cover 92 is in place, the tab 120 is bent to secure the side cover 92 to the frame member 12. Each side cover 92 also includes side panels 122 extending at right angles therefrom and having a circular aperture 124 and an elongated aperture 126 therein. As illustrated, the circular aperture 122 is located above the elongated aperture 124 for cooperation with specific apertures on the front and back panels.

More specifically, the front panel 96 includes a circular aperture 130 on each of the bottom corners thereof and near each of the lateral edges thereof, each aperture 130 registering with an elongated aperture 126 on a side panel 122 of a side cover 92. In contrast, the back panel 98 includes an elongated aperture 132 on each side thereof positioned near a lateral edge and at a height somewhat higher than a circular aperture 130 located oppositely thereof. Each elongated aperture 132 in the back panel 98 registers with a circular aperture 124 on a side panel 122 of a side cover 92. Rivets 140 are inserted through the registering apertures and are received thereon to secure the top wrap 100 and side covers 92 together to form the enclosure 90.

By having an elongated aperture 132 in the back panel 98 operatively associated with a circular aperture 124 in the side cover 92 and a circular aperture 130 in the front panel 96 operatively associated with an elongated aperture 126 of a side cover 92, it is possible to provide a slight adjustment in the enclosure 90 to accommodate manufacturing tolerances and plaster frame members that are somewhat twisted or otherwise bent out-of-shape due to uneven ceilings or tight fitting spaces into which they are crammed. The enclosure 90 can be put into place on the frame member 12 and then the side covers 92 and top wrap 100 can be jostled slightly until the enclosure 90 settles into place.

It can be appreciated that the enclosure 90 serves to form an air space about the lamp housing 14 and the top of the plaster frame member 12. This air space permits air flow about the lamp housing 14 and therefore, a lower temperature of operation of the fixture 16. Further, flammable insulation is maintained a safe distance from the lamp housing 14, thus reducing the risk of fire. Therefore, the enclosure 90 serves to reduce the operating temperature of the fixture 10 and to allow the use of higher wattage lamps.

While a preferred embodiment has been shown, modifications and changes may become apparent to those skilled in the art which shall fall within the spirit and scope of the invention. It is intended that such modifications and changes be covered by the attached claims.

I claim:

1. A socket plate member for a recessed ceiling lighting fixture having a lamp housing and a lamp socket, comprising:

a plate member adapted to be received in the lamp housing in vertically adjustable fashion and having an aperture therein adapted to receive the lamp socket and said plate member having a periphery that substantially conforms to an inner shape of the lamp housing;

a downwardly depending attaching and adjusting leg member attached at a right angle to an edge of the plate member, the leg member having a slot positioned along an axis oriented perpendicularly to the plate member and an aperture positioned along the axis in spaced relation to an end of the slot furthest away from a plane defined by the plate member;

a fastener carried by the lamp housing selectively seated in the slot or aperture to adjustably or fixedly position the level of the plate member relative to the lamp housing; and a pair of reinforcing ribs formed in the plate member and the attaching and adjusting leg member to maintain a fixed angular relationship between the leg member and the plate member plane.

2. The socket plate member of claim 1, including a pair of circumferentially spaced notches in the periphery of the plate member.

3. A recessed ceiling lighting fixture having a plaster frame to which are operatively attached a junction box, a lamp housing and a lamp socket, comprising:

an enclosure operatively attached to the plaster frame so as to surround the lamp housing and to create an enclosed air space about the lamp housing; and a socket plate adjustably positioned within the lamp housing and adapted to receive the lamp socket, the socket plate being formed of a plate member having a socket aperture and a downwardly depending leg member attached at a right angle to the plate member and having both a slot therein oriented perpendicularly to a plane defined by said plate member and an aperture positioned in spaced apart relation from the end of the slot most remote from the plane defined by the plate member.

4. A recessed ceiling lighting fixture as set forth in claim 3, wherein the enclosure is a rectangular box.

5. A recessed ceiling lighting fixture as set forth in claim 4, wherein the enclosure includes a sheet member bent along parallel lines to form front, top, and back sides of the enclosure.

6. A recessed ceiling lighting member as set forth in claim 3, wherein the socket plate leg member and the plate member include at least one common strengthening rib.

7. An enclosure for a recessed ceiling lighting fixture having a plaster frame and a lamp housing and a junction box operatively attached thereto, comprising:

two side covers, a front panel, a back panel, and a top panel operatively attached to each other so as to form a rectangular box having one open side, the side covers being operatively attached to the plaster frame, the front and back panels having one aperture near each lateral edge thereof and each of the side covers includes a pair of side panels extending at right angles from the side covers, each side panel having a pair of apertures, one of said pair of apertures registering and cooperating with one of the apertures of the front and back panels when the enclosure is operatively assembled; wherein one of the apertures on each of the side cover side panels is elongated, the other of the apertures on each of the side cover side panels is non-elongated; and the apertures in one of the front panel or the back panel are elongated, the aperture in the other of the front or the back panel are non-elongated; the elongated apertures in the side covers registering with the non-elongated apertures in the front panel or back panel and the non-elongated apertures in the side covers registering with the elongated apertures in the front panel or the back panel.

8. A recessed ceiling lighting fixture having a plaster frame to which are operatively attached a junction box and lamp housing, comprising:

an enclosure operatively attached to the plaster frame and surrounding the lamp housing, the enclosure having a rectangular box-shape and being formed by two side covers, a top panel, a back panel, and a top panel operatively attached to each other, the side covers being operatively attached to the plaster frame of the recessed ceiling lighting fixture; wherein the side cover includes side panels extending at right angles along lateral edges of the side covers and the front and back panels are secured to the side covers by means of a member extending through apertures in the side panels and the front and back panels, the front panel having one of elongated or non-elongated apertures and the back panel having the other of elongated or non-elongated apertures, each side panel having one elongated and one non-elongated aperture, the non-elongated apertures in the side panels registering with the elongated apertures in the front or back panel and the elongated apertures in the side panels registering with the non-elongated apertures in the back or front panel.

* * * * *

UNITED STATES PATENT AND TRADEMARK OFFICE

CERTIFICATE OF CORRECTION

PATENT NO. : 4,910,651

DATED : Mar. 20, 1990

INVENTOR(S) : Jesse J. Montanez

It is certified that error appears in the above-identified patent and that said Letters Patent is hereby corrected as shown below:

The sheets of drawing consisting of Figs. 1-4 should be added as per attached sheets.

Signed and Sealed this

Fourth Day of September, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,910,651
DATED : October 15, 1991
INVENTOR(S) : Douglas W. Carson and Raymond J. Kusmar It is certified that error appears in the above-identified patent and that said Letters Patent is hereby corrected as shown below:

Column 5,
Line 37, the word "plastic" should be the word -- plaster --.

Signed and Sealed this

Eighteenth Day of February, 2003

JAMES E. ROGAN
*Director of the United States Patent and Trademark Office*